United States Patent [19]

Ahs

[11] 4,339,206

[45] Jul. 13, 1982

[54] MIXING APPARATUS FOR MIXING A FLUID FIBER SUSPENSION WITH A TREATMENT FLUID SUSPENSION

[75] Inventor: Bjorn Ahs, Karlstad, Sweden

[73] Assignee: Kamyr AB, Karlstad, Sweden

[21] Appl. No.: 207,290

[22] Filed: Nov. 17, 1980

[30] Foreign Application Priority Data

Nov. 27, 1979 [SE] Sweden ..... 7909781

[51] Int. Cl.[3] ..... B01F 7/02

[52] U.S. Cl. ..... 366/307; 162/57; 162/243

[58] Field of Search ..... 366/302, 303, 304, 157, 366/307; 241/28; 162/57, 235, 236, 234, 243, 261

[56] References Cited

U.S. PATENT DOCUMENTS

| | | | |
|---|---|---|---|
| 2,008,892 | 7/1935 | Asplund | 241/28 |
| 2,573,321 | 10/1951 | Ernst | 162/236 |
| 2,645,464 | 7/1953 | Forbes | 366/304 |
| 2,934,278 | 4/1960 | Roberson | 241/28 |
| 3,327,952 | 6/1967 | Rosenfeld | 241/28 |
| 3,411,721 | 11/1968 | Delcellier . | |
| 3,428,262 | 2/1969 | Danforth | 241/28 |
| 4,288,288 | 9/1981 | Fleck et al. | 162/57 |

*Primary Examiner*—Steve Alvo

*Attorney, Agent, or Firm*—Cushman, Darby & Cushman

[57] ABSTRACT

A simple mixing apparatus provides especially for the mixing of treatment fluids with suspensions having a consistency of about 2–15%. First and second cylindrical coaxial housing parts are provided, the second part having a larger diameter than the first part. A fluid inlet introduces fluid axially into the first housing part, and a fluid outlet expels treated fluid tangentially from the second housing part. Stirring and mixing is provided by first and second stirring members rotatable about a common axis, the first stirring member having a number of axially extending, radially upstanding ribs cooperating with similar ribs on the interior of the first housing part, and the second stirring member having a number of radially extending, axially upstanding ribs cooperating with like ribs formed in the second housing part. The suspension is fluidized by the stirring members, and the residence time of suspension with the apparatus is between about 0.01 and 2.0 seconds.

6 Claims, 2 Drawing Figures

Fig. 1
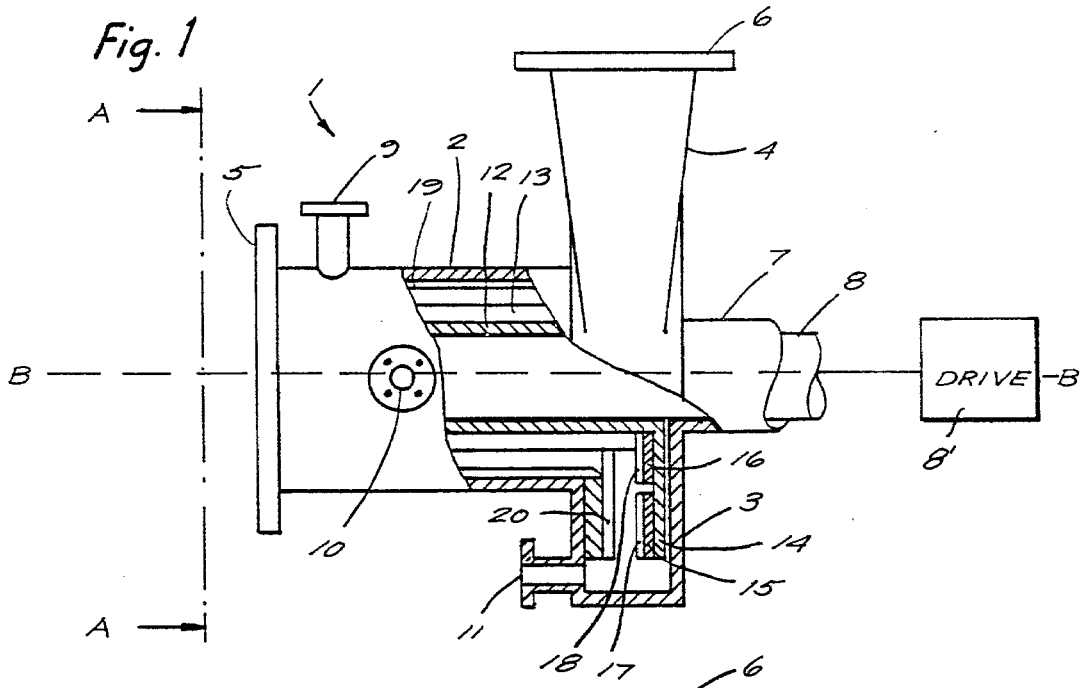
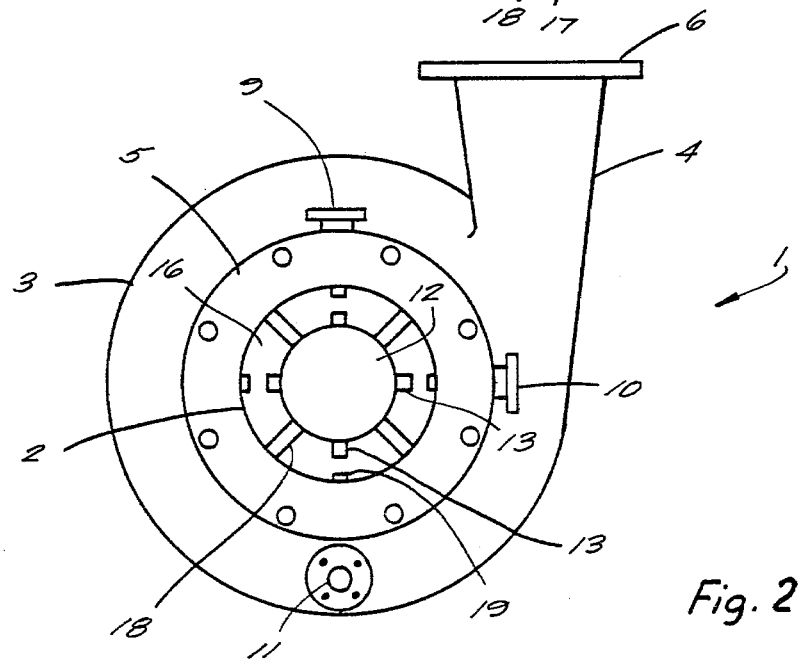
Fig. 2

MIXING APPARATUS FOR MIXING A FLUID FIBER SUSPENSION WITH A TREATMENT FLUID SUSPENSION

BACKGROUND AND SUMMARY OF THE INVENTION

The invention relates to an apparatus, and method of utilization thereof, primarily adapted for the mixing of chemicals in suspensions, such as mixing bleaching fluids (liquid or gas) in cellulosic fiber suspensions (particularly paper pulp).

According to the present invention, a mixing apparatus is provided that is capable of efficiently mixing chemicals with suspensions over a wide variety of suspension solids concentrations, and which is compact, simple, and relatively inexpensive. The apparatus according to the present invention is capable of efficient mixing of chemicals with pulp having a concentration range of about 2–15%, and preferably about 8–14%. The apparatus is operated in such a manner that fluidizing of the pulp is effected during mixing, and the total residence time within the mixing apparatus is considerably shorter than in conventional mixing apparatus (e.g., about 0.01–2.0 seconds, preferably 0.05–0.5 seconds).

The mixing apparatus according to the present invention comprising a housing having a first cylindrical housing part, and a second cylindrical housing part with a larger diameter than the first part. The housings are connected together so that the cylindrical axes thereof are substantially coextensive and so that the interiors thereof are in communication. A fluid inlet means is provided to the housing first part for introducing fluid axially into the first housing part, and a fluid outlet means is provided from the second housing part for expelling treated fluid tangentially from the second housing part. Treatment fluid inlet means introduces treatment fluid to the housing at one or more locations, preferably both in the first housing part and the second housing part.

The apparatus according to the invention further comprises means for effecting stirring of the suspension and mixing of treatment fluid with the suspension. Such means includes a shaft, means for mounting the shaft for rotation with respect to the housing about an axis substantially coaxial with the axes of the housing first and second parts, and first and second stirring members operatively mounted to the shaft and extending in the first and second housing parts, respectively. The first stirring member has a plurality of substantially axially extending, radially upstanding ribs formed on the axial periphery thereof, which cooperate with a plurality of radially spaced substantially axially extending, radially upstanding ribs formed on the interior of the first housing part. The second stirring member has a plurality of substantially radially extending axially upstanding ribs formed on a peripheral surface thereof, and cooperating with a plurality of axially spaced radially extending, axially upstanding ribs formed on the interior of the second housing part. A drive effects rotation of the shaft so that the stirring members fluidize the suspension, while the residence time of each increment of suspension is about 0.01–2.0 seconds.

According to the method of mixing treatment fluid with a suspension utilizing the apparatus heretofore described, a suspension having a solids consistency of about 2–15% (preferably 8–14%) is introduced axially into the first housing part. Treatment fluid is introduced into the suspension flowing in the first housing part to be mixed with the suspension, and suspension mixed with treatment fluid is withdrawn from the outlet. The first and second stirring members are rotated with respect to the housing at a speed sufficient to effect fluidization of all of the introduced suspension and to effect transport of the suspension from the inlet, past the ribs associated with the housing first and second parts and the first and second stirring members which effect mixing of the treatment fluid in suspension to the suspension outlet, providing a residence time within the housing of each increment of suspension introduced into the inlet of about 0.01–2.0 seconds (preferably 0.05–0.5 seconds). Chlorine and chlorine dioxide may be utilized as the treatment fluid, or oxygen may be utilized as the treatment fluid introduced radially into the first housing part, with an alkaline solution introduced at a peripheral point generally parallel to the axis of the housing parts into the second housing part.

It is the primary object of the present invention to provide a simple yet effective apparatus and method for mixing a fluid with a treatment fluid, particularly for mixing treatment fluids in high consistency suspensions. This and other objects of the invention will become clear from an inspection of the detailed description of the invention and from the appended claim.

BRIEF DESCRIPTION OF THE DRAWINGS

FIG. 1 is a side view partly in cross-section and partly in elevation of an exemplary mixing apparatus according to the present invention; and FIG. 2 is an end view of the apparatus of FIG. 1, as seen along lines A—A of FIG. 1.

DETAILED DESCRIPTION OF THE DRAWINGS

An exemplary apparatus according to the present invention includes a housing 1 comprising a first cylindrical housing part 2 and a second cylindrical housing part 3. The part 3 has a larger diameter than the part 2, and the parts 2, 3 are connected together so that the cylindrical axes B—B thereof are substantially coextensive and so that the interiors thereof are in communication. A fluid inlet means 5 is provided to the housing first part 2 for introducing fluid (suspension) to be treated axially into the first housing part 2. The housing 1 also includes a fluid outlet means 4 from the second housing part 3 for expelling treated fluid tangentially from the second housing part 3. The inlet means 5 includes a flange (see FIG. 2) for connecting it to a pipe or another piece of machinery, and the outlet 4 includes a flange 6 for connecting it to a pipe or another piece of equipment. Treatment fluid inlet means are also provided for introducing treatment fluid to the housing 1. In the embodiment illustrated in the drawings, the treatment fluid inlet means comprise three separate treatment fluid inlet pipes 9, 10, and 11. The pipes 9 and 10 are adapted to introduce treatment fluid radially into the first housing part 2, and are spaced both axially (along the axis B—B) and circumferentially around the circumference of housing part 2, from each other. The treatment fluid inlet 11 extends parallel to the axis B—B of a peripheral area of housing second part 3, spaced circumferentially from suspension outlet 4, and spaced radially outwardly from first housing part 2.

Means are provided for effecting stirring of the introduced suspension and mixing of treatment fluid therewith. Such mixing means include a shaft 8 with a bearing housing 7 or like structure for mounting the shaft 8 for rotation with respect to the housing 1 about axis B—B (or an axis substantially coaxial with axis B—B). A suitable drive 8' is provided for powering the shaft 8, such as the drive as is provided for the device in U.S. Pat. No. 4,093,506. The drive 8' is such that it can effect rotation of the shaft 8 (and stirring members connected thereto as will be hereinafter described) to effect fluidization of suspension introduced into the housing 1 through inlet 5, even if the suspension has a consistency of about 2–15%.

The stirring and mixing means further include a first stirring member 12 and a second stirring member 14. The members 12, 14 are operatively connected to the shaft 8 (as by keying means, not shown), and may be formed integrally with each other as illustrated in FIG. 1. The stirring member 12 has a plurality of substantially axially extending, radially upstanding ribs 13 formed on the axial periphery thereof, as illustrated in FIGS. 1 and 2. While the ribs 13 are shown as extending truly axially, in fact they could extend at an angle with respect to the axis B—B, be slighly curved, or have other suitable developments. A plurality of substantially axially extending, radially upstanding ribs 19 are formed on the interior of the first housing part 2, and are radially spaced from the ribs 13.

Second stirring member 14 is illustrated in the form of a ring, and has one or more other annular plate-like elements 15 and 16 mounted thereon. The elements 15, 16 are each equipped with substantially radially extending, axially upstanding ribs formed on a peripheral surface of each. These ribs are illustrated at 17 and 18 in the drawings. Again, the ribs may not be exactly radially extending but can have any configuration suitable for performing the intended function. The ribs 17, 18 cooperate with a plurality of stationary ribs 20 formed on the interior of the second housing part 3, and axially spaced (along axis B—B) from the ribs 17, 18.

The various ribs 13, 17, 18, 19, and 20 may vary widely in number and exact placement. In the embodiment illustrated in the drawings, the ribs are shown to be quadrate in cross-section, and four sets of each type of rib are provided, with the ribs 18 of the second stirring member 14 being offset from the ribs 13 of the first stirring member 12 (e.g., about 45° in the embodiment illustrated in the drawings).

In the utilization of the apparatus illustrated in the drawings, any type of treatment fluid can be effectively mixed with an introduced fluid. The apparatus is particularly effective for use with suspensions as the introduced fluid (e.g., having a consistency of about 2–15%), and particularly with bleaching chemicals utilized as the treatment fluid. The suspension is introduced into inlet 5, and within a first zone defined generally by the first housing part 2 mainly axial movement will be imparted to the suspension at the same time that it rotates within the housing under the influence of the ribs 13, 19. The suspension will usually be introduced under significant pressure. This first zone may be called the distributing zone. In a second zone defined generally by the second housing part 3, the suspension movement is primarily radial while at the same time some rotation is imparted thereto. This zone may be called the emulsifying zone. The particular construction and design of the apparatus is such that the total retention time within the housing 1 is considerably shorter than in conventional mixing apparatus, retention times of about 0.01–2.0 seconds being typical, and preferably about 0.05–0.5 seconds. This is particularly advantageous where cellulosic fibers form the suspension since such fibers are sensitive to mechanical treatment.

During movement of the suspension through inlet 5, first housing part 2, second housing part 3, and ultimately to outlet 4, treatment fluids (either liquid or gaseous) are introduced into the suspension. For instance in the treatment of pulp, chlorine dioxide can be added through inlet 9, and chlorine through inlet 10. A third treatment medium may be added through inlet 11, if desired. The inlet 11 is particularly useful when the method is utilized to effect oxygen bleaching of pulp. Oxygen is introduced through inlet 10 (and/or 9) and is effectively distributed in the suspension, while an alkaline solution is added through inlet 11. It is known that powerful stirring of alkaline pulp suspensions can lead to decreased strength properties of the finished pulp, and therefore by adding the alkaline solution through the inlet 11, located as it is in the total structure, adverse affect upon the pulp strength properties can be minimized while still effecting suitable mixing of the alkaline solution with the pulp.

It will thus be seen that according to the present invention an exemplary mixing apparatus, and method of utilization thereof, have been provided which will facilitate a simple yet effective mixing of an introduced fluid with a treatment fluid. Because the apparatus is so compact and utilizes only one rotating part, it is considerably simpler to construct and operate, and less expensive to construct than conventional mixing apparatus. Also, since the treatment of suspensions is effected by fluidizing the suspension the mixing is extremely effective, and the power consumption of the apparatus is considerably lower than for many conventional assemblies. The effectiveness of the apparatus results in a short retention time, with subsequent minimization of possibilities of mechanical degradation of the suspension fibers, and the compact size of the apparatus allows it to be utilized successfully directly in pipelines, and in many other environments (wherever convenient).

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Mixing apparatus for mixing a fluid fiber suspension with a treatment fluid, comprising:

a housing comprising a first cylindrical housing part, and a second cylindrical housing part having a larger diameter than said first cylindrical housing part, said first and second housing parts being connected together so that the cylindrical axes thereof are substantially coextensive and so that the interiors thereof are in communication;

a fluid suspension inlet means to said first housing part for introducing fluid suspension axially into said first housing part;

a fluid suspension outlet means from said second housing part for expelling treated fluid suspension tangentially from said second housing part;

treatment fluid inlet means for introducing treatment fluid to said first or second housing parts; and means for effecting stirring of the fluid suspension and mixing of the treatment fluid therein so as to thoroughly mix the suspension and treatment fluid with minimal mechanical degradation of the suspension fibers, said means comprising: a shaft; means for mounting said shaft for rotation with respect to said housing about an axis substantially coaxial with the axes of said housing first and second parts; a first stirring member operatively mounted to said shaft and extending in said first housing part, said first stirring member having a plurality of substantially axially extending, radially upstanding ribs formed on the axial periphery thereof; a plurality of substantially axially extending, radially upstanding ribs formed on the interior of said first housing part and radially spaced from said first stirring member ribs a substantial distance; a second stirring member operatively mounted to said shaft and extending in said second housing part, said second stirring member having a plurality of substantially radially extending, axially upstanding ribs formed on a peripheral surface thereof; and a plurality of substantially radially extending, axially upstanding ribs formed on the interior of said second housing part and axially spaced a substantial distance from said second stirring member ribs, and further comprising means for effecting rotation of said shaft, and said first and second stirring members operatively attached thereto, so that fluidization of suspension introduced into said inlet takes place.

2. Apparatus as recited in claim 1 wherein said treatment fluid inlet means comprises a first treatment fluid inlet for introducing treatment fluid radially into said first housing part, and a second treatment fluid inlet for introducing fluid into said second housing part.

3. Apparatus as recited in claim 2 further comprising a third treatment fluid inlet for introducing fluid radially into said first housing part, said third treatment fluid inlet being spaced from said first treatment fluid inlet both axially and around the periphery of said first housing part.

4. Apparatus as recited in claim 2 wherein said second treatment fluid inlet extends substantially in a straight line outwardly from said second housing part parallel to said axes of said first and second housing parts and radially outwardly of said first housing part, and spaced from said fluid outlet means around the circumference of said second housing part.

5. Apparatus as recited in claim 2 further comprising a third treatment fluid inlet for introducing fluid radially into said first housing part, said third treatment fluid inlet being spaced from said first treatment fluid inlet, both axially and around the periphery of said first housing part; and wherein said second treatment fluid inlet extends substantially in a straight line outwardly from said second housing part parallel to said axes of said first and second housing parts and radially outwardly of said first housing part, and spaced from said fluid outlet means around the circumference of said second housing part.

6. Apparatus as recited in claim 1 wherein all of said ribs are linear and are quadrate in cross-section, wherein said first and second stirring members are integral with each other, and wherein said first stirring member ribs are offset from said second stirring member ribs.

* * * * *